US005245247A

United States Patent [19]

Hosogi

[11] Patent Number: 5,245,247

[45] Date of Patent: Sep. 14, 1993

[54] MICROMINIATURE VACUUM TUBE

[75] Inventor: Kenji Hosogi, Itami, Japan

[73] Assignee: Mitsubishi Denki Kabushiki Kaisha, Japan

[21] Appl. No.: 644,995

[22] Filed: Jan. 22, 1991

[30] Foreign Application Priority Data

Jan. 29, 1990 [JP] Japan ..... 2-20126

[51] Int. Cl.[5] ..... H01J 19/24

[52] U.S. Cl. ..... 313/309; 313/306; 313/308; 313/311; 313/336; 313/351; 313/355

[58] Field of Search ..... 313/306, 309, 336, 351, 313/308, 311; 357/22 C, 22 R, 31, 55; 257/27, 12, 94, 100, 200

[56] References Cited

U.S. PATENT DOCUMENTS

| | | | |
|---|---|---|---|
| 3,814,968 | 6/1974 | Nathanson et al. | 313/309 X |
| 4,168,213 | 9/1979 | Hoeberechts | 204/15 |
| 4,513,308 | 4/1985 | Greene | 357/55 |
| 4,578,614 | 3/1986 | Gray et al. | 313/309 |
| 4,827,177 | 5/1989 | Lee et al. | 313/309 X |
| 4,853,754 | 8/1989 | Van Gorkom et al. | 357/31 X |
| 4,855,636 | 8/1989 | Busta et al. | 313/306 |
| 4,904,895 | 2/1990 | Tsukamoto et al. | 313/336 |

FOREIGN PATENT DOCUMENTS

| | | |
|---|---|---|
| 260075 | 3/1988 | European Pat. Off. . |
| 290026 | 11/1988 | European Pat. Off. . |
| 306173 | 3/1989 | European Pat. Off. . |
| 354750 | 2/1990 | European Pat. Off. . |
| 406886 | 1/1991 | European Pat. Off. . |

OTHER PUBLICATIONS

"A Vacuum Field Effect Transistor Using Silicon Field Emitter Arrays", Gray et al., Proc. IEDM86, pp. 776–779; Dec. 1986.

"Vacuum Microelectronics", Junji Itoh, Electrotechnical Laboratory, Nov. 29, 1989, pp. 164–169.

*Primary Examiner*—Donald J. Yusko
*Assistant Examiner*—Ashok Patel
*Attorney, Agent, or Firm*—Leydig, Voit & Mayer

[57] ABSTRACT

A microminiature vacuum tube and a process for fabrication thereof. The tube is formed on a compound semiconductor substrate using solid state semiconductor fabrication techniques. A straight line path for electron flow is provided by forming an emitter and collector in the same plane. The emitter and collector are formed in a low resistance layer of a compound semiconductor substrate, such as by etching a recess through the low resistance layer and into the substrate to define a separate emitter and collector. Preferential etching techniques are utilized to form a sharp-edge in at least the emitter portion of the recess. A gate is formed in the recess proximate to but out of the plane for electron flow. The use of microminiature solid state fabrication technique allows the recess to be formed at submicron size to reduce the voltage requirements on the microminiature vacuum tube.

8 Claims, 7 Drawing Sheets

MICROMINIATURE VACUUM TUBE

FIELD OF THE INVENTION

This invention relates to vacuum tubes, and more particular to microminiature vacuum tubes particularly suited for enhanced high frequency operation.

BACKGROUND OF THE INVENTION

As a generality, it can be said that the development of the transistor and the solid state technology which followed the transistor have largely supplanted the use of the vacuum tube. Conventional consumer devices, as well as commercial devices, military devices, and the like, are typically of the solid state variety for a number of reasons. Conventional vacuum tubes are substantially larger than functionally equivalent solid state devices, are inferior in terms of reliability, and consume substantially more power as compared to their solid state counterparts. Furthermore, it has been difficult if not impossible to produce highly functional integrated circuits utilizing vacuum tubes because of their operational and dimensional restrictions. Thus, it can be said that, generally, the vacuum tube device has been superseded by solid state devices.

However, when very high frequency operation is the paramount concern, vacuum tube devices have an advantage over solid state devices. More particularly, at frequencies in the GHz range, delays due to carrier travel become more significant, and the velocity of carriers through the medium of the device becomes increasingly important. It is known that electron travel through semiconductors is slower than electron travel in a vacuum, providing at least a theoretical advantage for the vacuum tube structure, if the path length for carrier travel can be made sufficiently small. Assuming travel distances by carriers can be made comparable, it would be of advantage to provide a structure with carrier travel through a vacuum, rather than through solid state semiconductor material, in order to enhance high frequency response by enhancing carrier transit time.

A disadvantage of vacuum tubes can be avoided if the emitter and collector of the vacuum tube can be located very close to each other. More particularly, by reducing the gap between emitter and collector electrodes to, for example, the order of microns, it becomes possible to emit electrons from a cold cathode (or emitter) by means of electric field emission, eliminating the need for cathode heaters which had been a source of high power dissipation in conventional electron tubes. Cold emitter operation by electric field emission requires not only the very close proximity of the emitter and collector, but also shaping of at least the emitter to enhance the field intensity at a sharp edge on the emitter, thereby locally enhancing the field strength which results in electron emission and travel from emitter to collector.

FIG. 10 shows a cross sectional view of a microminiature vacuum tube of the prior art as described in "A Vacuum Field Effect Transistor Using Silicon Field Emitter Arrays" published in the proceedings of the International Electronic Device meeting 1986 at page 776.

As shown in FIG. 10, a silicon substrate 1 has an insulating film (such as silicon dioxide) formed on the upper surface thereof. Disposed in a gap in the insulating film 2 is a conical cathode 3 (or electron emitter) which is formed by etching the silicon substrate 1. Formed on the surface of the insulating film 2 are an arrangement of anodes 4 (or collector electrodes) and a further intermediate arrangement of control electrodes 5 (hereinafter called gate electrodes). As shown by the dotted line path $e^-$, electrons emitted from the emitter 3 travel by means of an arcuate path to the collector 4 under the control of voltages imposed on the gate 5.

The microminiature vacuum tube of FIG. 10 represents an attempt to realize certain of the advantages of vacuum tube performance (electron speed) utilizing certain features of microelectronic processing. However, the device is deficient for a number of reasons, one of them being the indirect path for electron travel in which electrons must be emitted from the conical emitter 3 and then flow in an arcuate path about the gate 5 to reach the collector 4.

A further problem results from the fabrication process for forming the device which is not without its difficulties. FIGS. 11*a*–11*d* illustrate the prior art process. As shown in FIG. 11*a*, a silicon substrate 1 has an n-type silicon layer 3*a* formed on the surface thereof, such as by conventional epitaxial growth processes. The central portion is masked using photolithographic processes to form a centrally disposed metallic etching mask 11 for formation of the conical emitter 3.

As shown in FIG. 11*b*, the partly completed wafer is then etched by isotropic etching techniques, such as wet etching, conventionally used for silicon, with the metal film 11 as a mask. Because of the isotropic etching techniques, side etching causes the masked portion of the layer 3 to etch more quickly than the portion adjacent the substrate 1, resulting in the illustrated conical shape for the emitter 3.

Having formed the conical emitter, and with the metal film 11 remaining in place, an insulator film 2 is then deposited over the entire surface of the substrate 1, but leaving the central masked portion free of insulator film, as shown in FIG. 11*c*. The film 11 is then removed and gate electrodes 5 and collector electrodes 4 are formed by conventional sputtering and patterning techniques.

As noted above, problems can arise in following the process sequence illustrated in FIGS. 11*a*–11*d*. One of those problems is illustrated in FIG. 12 which shows the variations which can accompany the isotropic etching technique used for forming the conical emitters. More particularly, utilizing the process illustrated in FIGS. 11*a*–11*d*, it is quite difficult to reproducibly achieve conical electrodes of the desired size and shape. Because the wet etching process is difficult to control and therefore to reproduce from batch to batch, when a plurality of emitter electrodes 3 are formed on a single silicon substrate, a non-uniformity of the shape of the emitter electrodes is often produced as shown in FIG. 12. It is seen that central conical emitter 3*c* is of the desired shape and size at the conclusion of etching, whereas emitter 3*d* represents the over-etched condition in which the emitter electrode is foreshortened, and electrode 3*b* represents the under-etched condition in which the emitter is not etched to a point. This non-uniformity in etching conditions results in a non-uniformity of characteristics of the devices, which is particularly significant when a plurality of such devices are used in an array of interconnected vacuum tube triodes.

Also as noted above, when a microminiaturized vacuum tube assumes the configuration shown in FIG. 10, electron travel from emitter 3 to collector 4 is in an arcuate path. Because of the arcuate path it is difficult to reduce the distance between the emitter 3 and the collector 4, and that results in a requirement for higher operating voltages. It will be appreciated, of course, that the greater the distance between the emitter and collector in a cold cathode electron discharge device, the greater the operating voltages will be needed to initiate discharge. And utilizing an arcuate path as shown in FIG. 10, and keeping in mind that a gate electrode must be interposed somewhere with respect to an intermediate portion of that path, one will appreciate that the degree to which the device of FIG. 10 can be miniaturized is somewhat limited.

SUMMARY OF THE INVENTION

In view of the foregoing, it is a general aim of the present invention to provide a microminiature vacuum tube having substantially reduced operating voltage requirement by optimizing the electrode shapes and relationships. In that regard, an object of the present invention is to provide a microminiature vacuum tube utilizing semiconductor processing techniques which provides a straight and very short direct path for electron flow from emitter to collector.

A further object of the present invention is to provide such a microminiature vacuum tube which utilizes preferential etching or preferential growth techniques in optimizing the shapes of the emitter and the emitter/-collector interrelationship.

An object of the present invention is to provide a microminiature electron tube with a straight line path for electron flow between gate and cathode, and which provides a gate which controls the electron flow across the linear path but without interrupting even a part of the path.

In summary, an object is to provide a vacuum tube which is microminiaturized to the greatest extent possible and which provides for relatively low operating voltages as a result of miniaturized gap and optimizing electrode shapes.

In accordance with the invention, there is provided a microminiature vacuum tube adapted to control electron travel in a vacuum. A compound semiconductor substrate has a low resistance compound semiconductor layer formed on a first planar surface thereof. An elongate recess penetrates the low resistance layer and extends into the substrate. The recess defines an emitter and a collector in the plane of the low resistance layer, and providing a direct path in that plane for electron flow from emitter to collector. A gate electrode is disposed proximate but not projecting into the path. Preferably the gate electrode is deposited in the recess. The low resistance layer is sufficiently thin and the crystal structure oriented to provide a sharp edge at the recess for at least the emitter which enhances the emission of electrons for flow along the linear path to the collector under the control at the gate.

According to the process aspects of the invention, a substrate is provided having a compound semiconductor crystal structure, and having a low resistance layer on a first planar surface thereof. A recess is etched through the low resistance layer and into the substrate such that the recess defines an emitter and a collector in the plane of the low resistance layer. A gate electrode is disposed proximate but not projecting into the path for electron flow between emitter and collector. An etching step is performed in a preferential orientation dependent fashion to produce a sharp edge in the low resistance layer at the recess for at least the emitter.

It is a feature of the invention that the emitter and collector can be displaced by a submicron gap, with the result being the substantial reduction in operating potentials needed to cause emission of electrons for flow from emitter to collector.

It is a further feature of the invention that the gate which controls electron flow is located proximate but out of the path of the straight line electron flow from emitter to collector.

A final aspect of the invention is the preferential etching technique which the crystal planes are oriented such that the etching which forms the recess, which in turn forms the emitter and collector, produces sharp edges and at least the emitter to enhance field intensity at the emitter and thus reduce the potentials necessary for electron flow.

Other objects and advantages will become apparent from the following description when taken in conjunction with the drawings in which:

DETAILED DESCRIPTION OF THE PREFERRED EMBODIMENTS

While the invention will be described in connection with certain preferred embodiments, there is no intent to limit it to those embodiments. On the contrary, the intent is to cover all alternatives, modifications, and equivalents, falling within the spirit and scope of the invention as defined by the appended claims.

Figure 1:
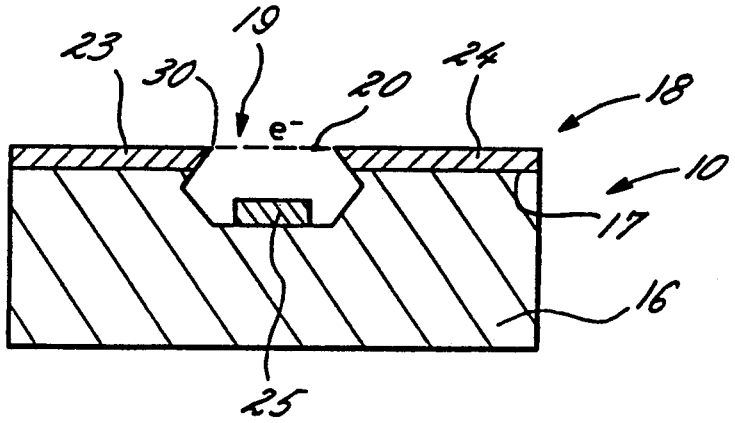
FIG. 1 is a cross sectional diagrammatic view showing the major elements of a microminiature vacuum tube exemplifying the present invention.
Figure 2:
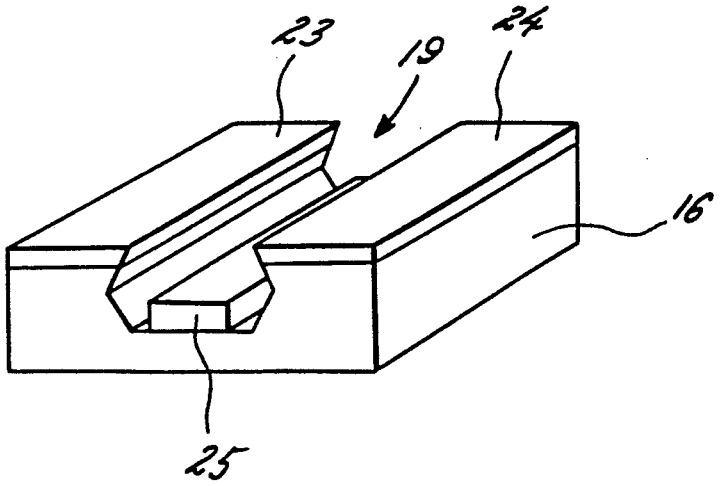
FIG. 2 is a perspective view showing the device of FIG. 1.

Turning now to the drawings, FIGS. 1–2 shown in cross-sectional elevation and perspective, respectively, a microminiature vacuum tube 10 exemplifying the present invention. The device is formed on a compound semiconductor substrate 16, preferably semi-insulating GaAs. The substrate 16 has an upper generally planar surface 17 on which is disposed a low resistance layer generally indicated at 18. As shown in FIGS. 1–2, the low resistance layer 18 is divided by a recess 19 which penetrates through the low resistance layer 18 and into the substrate 17. The recess 19 divides the low resistance layer 18 into an emitter 23 and a collector 24, in the same plane (the plane defined by the low resistance layer 18) and separated by a narrow gap defined by the recess 19. As shown by the dashed path for electron flow designated $e^-$ a direct linear path 20 for electron flow is provided between emitter 23 and collector 24. Electron flow is controlled by a gate 25 which is preferably formed in the trough of the recess 19, such that the gate 25 is proximate the path 20 but just out of the path. As a result, electron flow is substantially unhindered from emitter to collector, with little if any current being drawn to the gate electrode 25. The device is sealed and evacuated such that the path 20 for flow of electrons is a vacuum path for maximizing the speed of electron travel over the path.

It is worthy of note that the emitter 23 particularly has a relatively sharp edge 30 facing the collector 24, the edge providing for the concentration of the electrical field to facilitate discharge of electrons from the emitter for flow to the collector. The sharp edge is achieved first of all because of the fact that the low resistance layer 18 which forms the emitter and collector 23, 24 is relatively thin, on the order of about a micron. Secondly, because of the preferential etching technique to be described in detailed below, the low resistance layer 18 tends to undercut (as best illustrated in FIG. 1), providing an upper pointed edge 30 directed toward the gap (and therefore toward the collector). When a DC potential is connected to electrical contacts (not shown) which in turn are in electrical contact with the emitter and collector 23, 24, the applied DC voltage appears as a field across the narrow gap 19. That voltage, in combination with the DC potential between gate 25 and emitter 23 serves to produce a field which, considering the narrow gap 19 tends to dislodge electrons from the emitter for travel to the collector.

Figure 10:
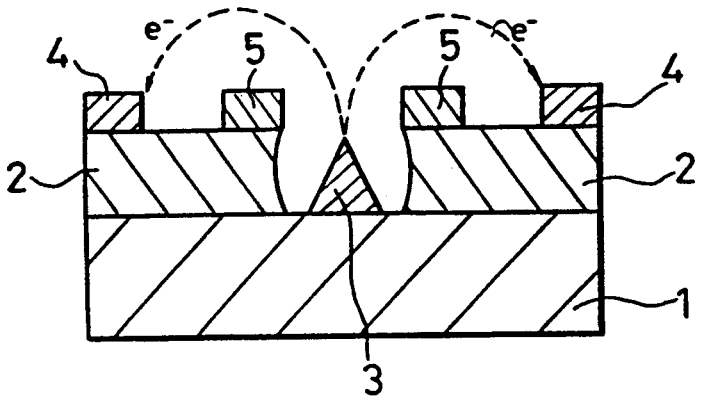
F I G .10. (PRIOR ART)
FIG. 10 is a cross sectional view illustrating a microminiature vacuum tube according to the prior art.
Figure 12:
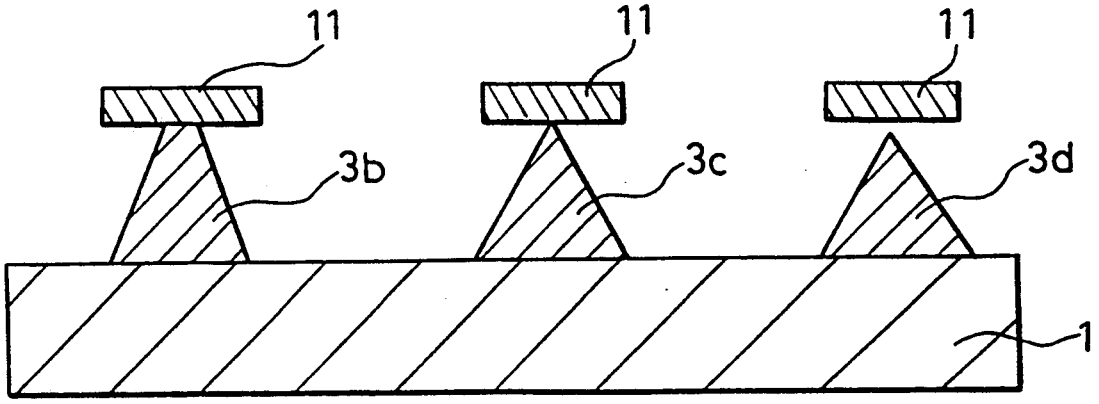
F I G .12. (PRIOR ART)
FIG. 12 is a sectional view illustrating certain difficulties which can be encountered in practice of the process illustrated in FIGS. 11*a*–11*d*.
Figure 11A:
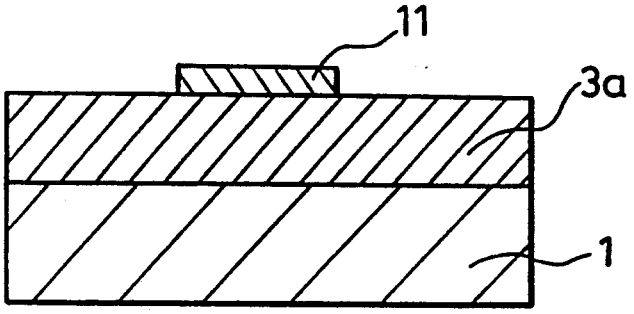
FIG.11(a) (PRIOR ART)
FIGS. 11*a*–11*d* illustrate the process steps for forming the device of FIG. 10.
Figure 11B:
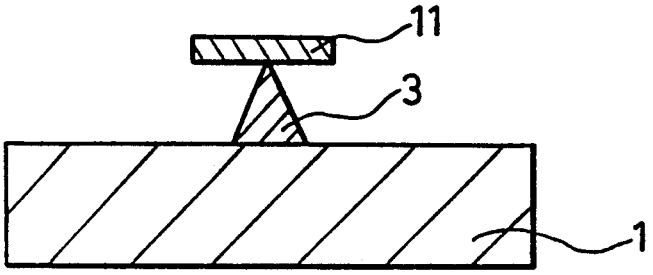
FIG.11(b) (PRIOR ART
Figure 11C:
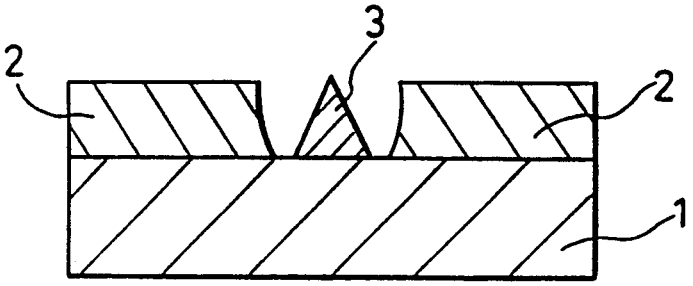
FIG.11(c) (PRIOR ART)
Figure 11D:
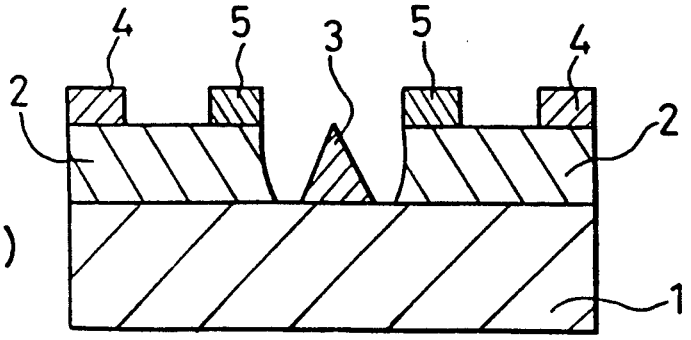
FIG.11(d) (PRIOR ART)

The substantially proximate spacing between the emitter and collector 23, 24 according to the invention, as contrasted with the comparatively wider spacing necessitated by the prior art (see FIG. 10) is of particular note. Utilizing conventional microelectronic processing techniques, the gap 19 can be made of submicron size. Such gap is preferably on the order of one micron or less, most preferably about 0.5 micron or less. The smaller the gap can be made (with repeatability), the smaller the voltage requirements for operation of the vacuum tube become, since the electric field necessary to dislodge electrons from the emitter for travel to the collector is inversely proportional to the separation between those elements. In accordance with the invention, the emitter and collector are provided with a very miniaturized gap therebetween, by disposing those elements in the same plane, separated by a very small gap which is readily controllable to submicron size by use of microelectronic processing techniques, with the arrangement providing for juxtaposition of a gate electrode proximate the linear path for electron flow, but slightly out of the plane of flow. The ability to position the gate electrode in the gap which creates the recess (and thus the separation) allows the gate to be very close to the path of electron flow so that it can control the electron flow without the need for excessively high potential, while being slightly out of the path so that the electrons which are emitted by the emitter are not captured by portions of the gate which would otherwise be disposed in and therefore interrupt the path of electron flow.

Using the structure according to the invention is expected to allow for emitter to collector voltages on the order of 100 volts, in contrast to the prior art which requires on the order of 200–300 volts from emitter to collector, and on the order of 100 volts from emitter to gate. To the extent the recess can be controlled in dimensions substantially below 0.5 micron, say to 0.1 micron, it may be possible to even further reduce operating voltages.

Before outlining additional important advantages of the invention, the process for forming the device of FIGS. 1–2 will first be described.

Figure 3A:
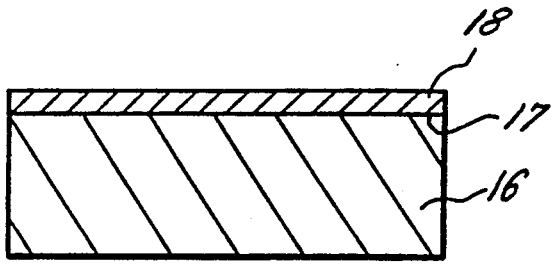
FIGS. 3*a*–3*e* illustrate the process steps for forming the device of FIGS. 1 and 2.
Figure 3B:
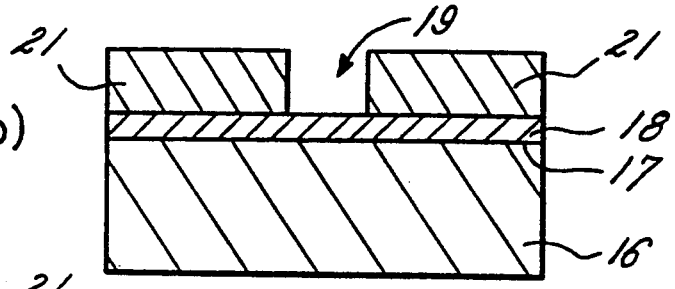

FIG. 3*a* shows a semiconductor substrate 16, preferably GaAs having an upper planar surface 17 on which is formed a low resistance semiconductor layer 18. The low resistance layer is formed by associating dopant impurities with the upper surface 17 of the semiconductor layer. Those impurities can be associated by incorporating them into the upper surface of the substrate 16 as by ion implantation/annealing, diffusion, or the like. Alternatively, the impurities can be associated with the upper surface 17 as by growing additional crystal layers by the various forms of epitaxial growth processes used in semiconductor fabrication. The composite layers 16, 17 have a crystalline structure which is suitable for orientation preferential etching as will be described below. FIG. 3*b* shows the substrate prepared for such etching by formation of a photoresist mask 21 over the surface of the low resistance layer 18. The photoresist mask 21 is patterned with a central aperture 19 by conventional techniques, the aperture 19 serving to expose the central portion of the low resistance layer 18. The aperture 19 is preferably less than one micron in width and can be formed using ordinary photolithographic technology and conventional resist material. Precision mask alignment conventionally used in semiconductor fabrication allows the control of the width and placement of the recess 19 with submicron precision.

Figure 3C:
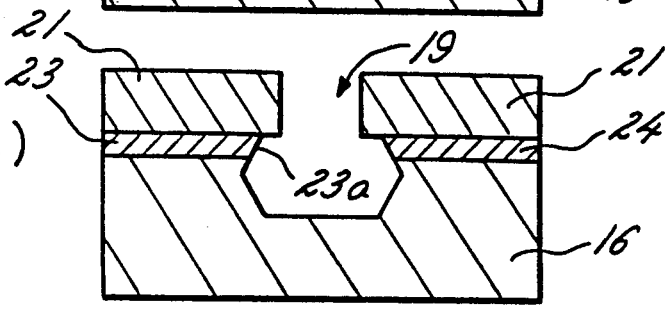

Having masked the partially completed device as illustrated in FIG. 3*b*, an orientation sensitive preferential etching technique is employed to etch a central recess as illustrated in FIG. 3*c*. For example, etching can be accomplished using a mixture of sulfuric acid ($H_2SO_4$) and hydrogen peroxide ($H_2O_2$). As is well known, in compound semiconductor devices, and particularly in the compound semiconductor GaAs crystalline structure, etching velocity is dependent on the surface orientation of the crystal. Thus, it is possible to etch a cross sectional shape as illustrated in FIG. 3*c* with good reproducibility by appropriately orienting the crystal structure of the substrate 16, 18 so that etching which proceeds from the upper surface of the low resistance layer 18 will form the desired pattern. When using gallium arsenide, the (100) crystalline plane of the substrate is aligned with the upper surface of the crystalline structure. Thus, the direction in which the crystal orientation dependent etching proceeds most quickly is defined in the direction $[01\bar{1}]$ which is the direction substantially perpendicular to the paper face of the illustration of FIG. 3*c*. Thus, etching will proceed quickly along the length of the recess, will, be retarded immediately adjacent the mask 21 but will etch more quickly to form the somewhat angularly defined bulge shape shown in FIG. 3*c*. That shape produces a knife edge 30 at the recess side of the emitter 23 with that face of the crystal structure presenting an angle of approximately 45° with the vertical. The creation of the knife edge 30 and the resulting point oriented toward the collector 24 serves to concentrate the electric field at the point of the knife edge which reduces the requirement for high voltages to cause cold cathode emission, and thus renders the emitter 23 particularly effective in such a cold cathode device. It is noted that the collector 24 has a similarly formed knife edge due to the fact that the right hand portion of the groove etches the same as the left hand. However, it is the knife edge at the emitter portion which is most effective in reducing the operating voltages necessary, since it is the emitter which benefits most from the high field concentration resulting from a knife edge.

Figure 3D:
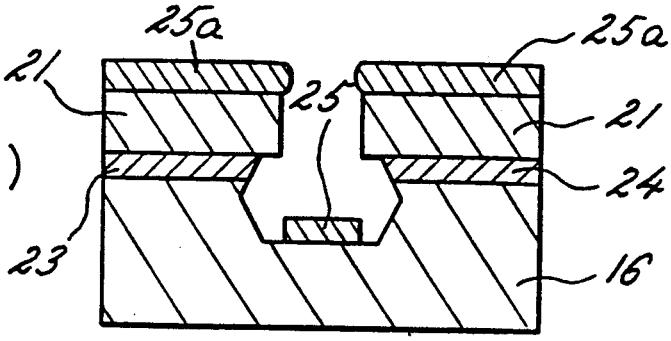
Figure 3E:
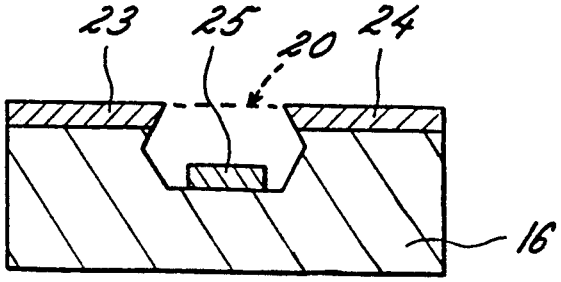
Figure 4:
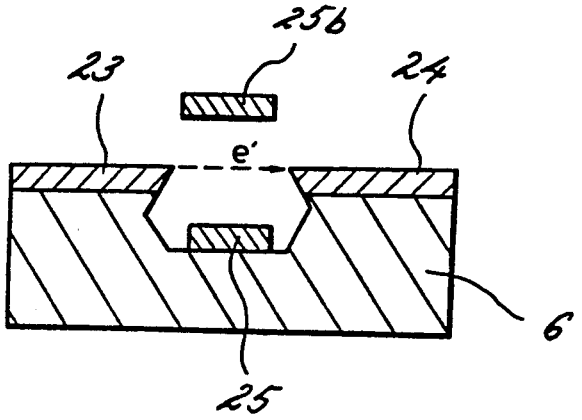
FIG. 4 is a cross sectional diagram illustrating an alternative embodiment of the present invention.

After formation of recess 19 by orientation sensitive preferential etching techniques as described in detail above, a gate electrode 25 (see FIG. 3*d*) is deposited and patterned by means of lift-off techniques. A gate metallic film 25, 25*a* is deposited over the entire surface of the semiconductor in its FIG. 3*c* condition using conventional microelectronic processing techniques such as vacuum evaporation. A layer of gate metal 25 is deposited in the recess to serve as the gate electrode. Simultaneously, metal layers 25*a* are deposited over the photoresist 21 as shown in FIG. 3*d*. When the photoresist 21 is removed, as with an organic solvent, the metal layers 25*a* are also removed, leaving the gate electrode 25 deposited on the horizontal surface of the recess 19. The depth of the recess 19 and the thickness of the gate metal layer 25 are coordinated such that the gate electrode is proximate the imaginary line 20 between the emitter and collector but located just out of the path of the line 20 such that the path 20 is unhindered by the gate electrode, even though the gate electrode is disposed so near the path as to exert substantial control over electron flow over the path. The final configuration of the device is illustrated in FIG. 3*e*.

The completed device, as illustrated in somewhat larger scale in FIG. 1 is operated by applying a DC potential between emitter and collector, with the more positive side being connected to the collector 24. A positive voltage (with respect to the emitter) is also applied to the gate 25, and the combined field exerted by the positive biasing potentials on the gate and collector serves to generate a field at the knife edge 30 which is sufficient to cause emission of electrons. Those electrons travel along the path 20 and are collected by the collector 24. The total field is influenced by the bias applied to the gate 25, and thus the magnitude of electron flow along the line 20 is a function of the bias applied to the gate. Thus, it will be appreciated that the device of FIG. 1 functions as a triode vacuum tube, but without the need for power to heat the cathode.

Furthermore, the very minute gaps established between the emitter and collector, as noted above, serve to reduce the biasing potentials needed, since a closely spaced emitter and collector (particularly with a properly shaped emitter as taught herein) will serve to create electric field concentrations at the knife edge which exceed the breakdown voltage and cause the emission of electrons. With the gap 20 maintained at 0.5 microns or less, as noted above, the device can be operated with only about 100 volts bias between emitter and collector, and correspondingly less modulating voltage on the gate.

Figure 7:
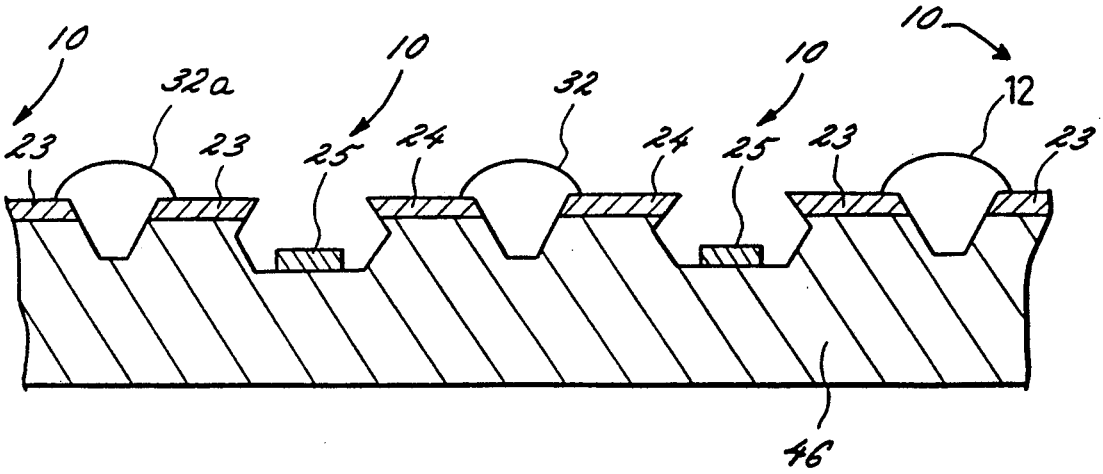
FIG. 7 is a diagram illustrating a planar array of microminiature vacuum tubes exemplifying the present invention.

As will now be apparent, the formation of electrodes for the device of FIG. 1 is similar to the structure used in conventional field effect transistors. Thus, it is possible to utilize those techniques to readily integrate a plurality of microminiature vacuum tube devices into a single circuit. Digressing briefly to FIG. 7, there is shown an array of such devices including a single substrate 46 having a plurality of microminiature vacuum tubes 10 formed thereon. It is seen that emitters 23 and collectors 24 of all of the vacuum tubes in the array are in substantially the same plane, with each of the vacuum tubes 10 having a recess containing a gate 25, so that the devices can be connected in series or parallel as desired for increasing the current carrying capacity of the array over that of individual devices. Jumpers 32 connect selected emitters or collectors as illustrated in FIG. 7 to cascade or parallel the devices as desired. The jumpers 32 are readily formed by a metallization step, performed subsequent to the formation of the triode devices as illustrated in FIGS. 3*a*–3*e*. Furthermore, because all of the grooves are etched to substantially the same depth because of the concurrent etching in the above described selective etching process, and because the shape of the emitter follows from the orientation of the crystal which is identical from device to device, the plurality of devices which make up the array will have very substantially the same electrical characteristics. The reliability and characterizability of the device in accordance with the invention will thus be appreciated.

Focusing once more on the shape of the emitter electrode 23, and particularly its knife edge 30, it will be appreciated that the shape of the knife edge is not substantially affected by etching conditions because of the orientation dependent etching technique utilized. More particularly, because the knife edge 30 is formed at the interface with the mask, and because the etching attacks the crystal according to the crystal orientation which is predetermined prior to the commencement of etching, it is possible to process and form the emitter electrodes in an automatic fashion without extremely precise control while still generating electrodes of the proper shape and size. The back etching or undercutting of the electrode 23 beneath the mask 21 (see FIG. 3*c*) is not greatly affected by time or temperature variations in etching within reasonable limits, and certainly the shape of the knife edge will not be affected, allowing the process to be run under reasonable process conditions and controls without the danger of detrimentally affecting the shape of the emitter or affecting, within tolerable limits, the dimension of the recess 19.

Figure 5:
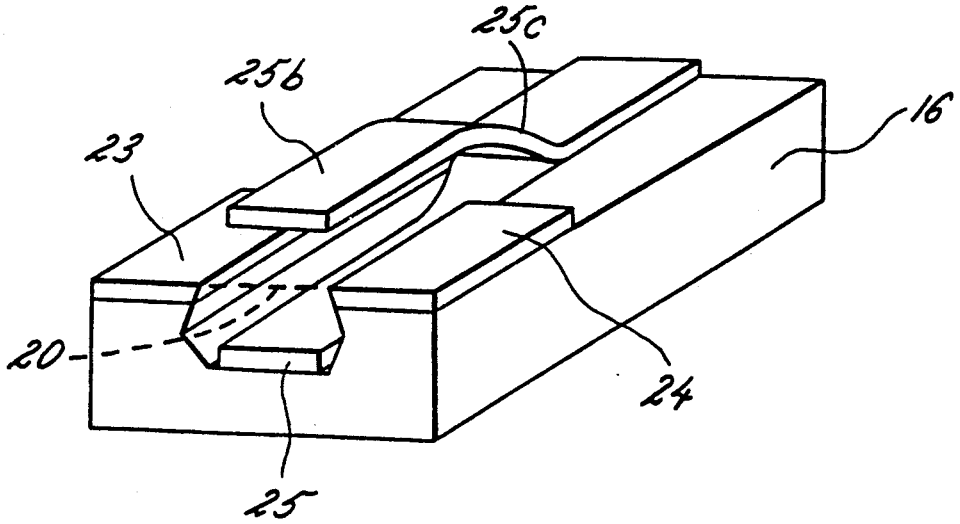
FIG. 5 is a perspective view of the device of FIG. 4.

In the embodiments described thus far, only a single gate electrode 25 is utilized, and it is preferably disposed at the base of the recess 19. FIG. 5 illustrates an alternative form of the invention in which a pair of gate electrodes 25, 25*b* are provided, one on either side of the line 20 defining electron travel. FIG. 5 is a perspective view which illustrates the device in section, it being appreciated that the electrode 25*b* is formed by the relatively conventional air bridge technique, having a first leg 25*c* descending to the substrate for support, and a similar leg (not shown) at the other side of the air bridge 25*b* for further support. The gate electrode 25*b* is preferably displaced from the line 20 by a distance corresponding to the distance between the electrode 25 and the line 20.

Typically both the lower 25 and upper 25*b* gate electrodes will be operated at the same electrical potential with respect to the emitter to create a uniform field in the region separating the emitter 23 and collector 24. The more symmetrical field in the region of the emitter 23 created by the dual gate structure 25, 25*b* of FIG. 5 tends to improve the controllability of current flow through the device.

Figure 9:
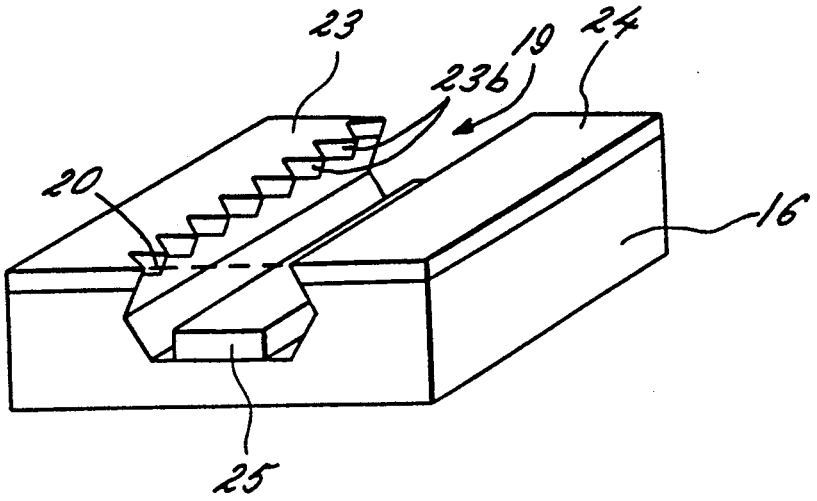
FIG. 9 represents an alternative embodiment of the invention which can be employed with other of the embodiments and showing the formation of a saw tooth emitter for further enhancing the field potential at the emitter and thus allowing further reduced operating potential.

It was noted above that the emitter electrode 23 was the primary electrode which required the knife edge, and that the provision of a similar knife edge for the collector 24 was incidental. FIG. 9 further exemplifies the desirability of high field concentrations, and shows an emitter electrode structure which provides high localized field concentrations. FIG. 9 shows a collector electrode 24 shaped much like the collector electrode of FIGS. 1-5. However, the emitter electrode 23*a* of FIG. 9 is formed in a sawtooth configuration having a plurality of points 23*b* facing the collector electrode 24.

The device of FIG. 9 is preferably formed by a subsequent etching step using a sawtooth shaped mask following the step of FIG. 3*e*. More particularly, a sawtooth shaped mask is deposited and lithographically patterned on the device in the condition shown in FIG. 3*e*, and an etching step performed to form the points 23*b* illustrated in FIG. 9. Alternatively, the masking step of FIG. 3*c* is altered to form a sawtooth shape in the mask portion 21 over the emitter electrode 23, so that etching of the groove simultaneously forms the points 23*b* in the sawtooth shaped emitter 23.

In either event, by forming the extremity of the emitter electrode 23 in the sawtooth etched shape illustrated in FIG. 9, it is possible to further increase the sharp edged discontinuities on the emitter at the point most closely proximate the collector, and thus increase the concentration of the electrical field in the area most useful for initiating an electrical discharge.

The embodiments described to this point have relied on orientation sensitive preferential etching for forming the recess between the emitter and collector portions of the low resistance electrical layer, and also for appropriately shaping at least the emitter electrode. In practicing the invention it is also possible to utilize orientation sensitive crystal growth, rather than crystal etching techniques to appropriately form a device embodying the invention.

Figure 6:
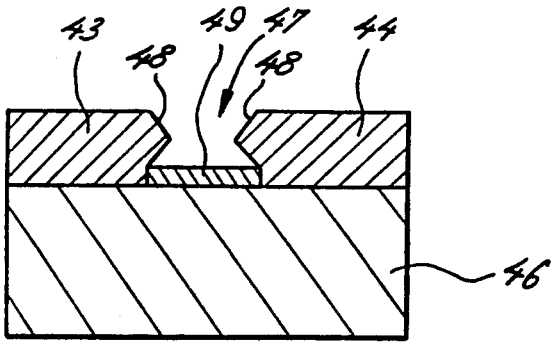
FIG. 6 is an elevational view showing a further embodiment of the invention utilizing crystal growth techniques for formation of the emitter and collector structures.

FIG. 6 illustrates use of a selected epitaxial growth process for formation of a triode according to the present invention. More particularly, in the device of FIG. 6, a semiconductor substrate 46 has a central portion thereof covered with an insulator film 49 in the form of an elongate strip. The elongate strip defines an area analogous to the etched groove 19 of the prior embodiments. Having deposited and patterned the insulator film 49, GaAs emitter and collector regions 43, 44 are then formed by selected epitaxial growth. For example, if the crystalline structure is grown in the temperature range between about 400° C. and 500° C. by metal organic chemical vapor deposition (MOCVD) techniques, utilizing a gas comprising TMGa (trimethyl gallium) or TEGa (triethyl-gallium) and $AsH_3$ (arsine) or the like, crystal growth occurs as shown in FIG. 6. More particularly, the crystal grows only on the crystalline substrate 46 and not on the insulator 49, but as the thickness of the layers 43, 44 grows beyond the thickness of the insulator 49, overhang portions 46 develop constricting the gap 47 and forming a knife-shaped edge 48 on the emitter 43 facing the collector 44. A similar knife-shaped edge 48 on the collector faces the emitter at the same level and produces a narrow and controlled gap 47 separating the emitter and collector. By selecting the surface direction of the substrate 46 before crystal growth is commenced, the emitter electrodes 43 and collector electrode 44 are formed as shown in the figure. Thus, when using GaAs as the substrate and GaAs as the compound semiconductor for emitter and collector, when the (100) crystalline face of the substrate 46 is oriented as the upper layer to receive the crystal growth, the most rapid crystal growth velocity is in the direction of $[01\bar{1}]$. It is then possible to obtain crystal growth in the shape of the overhang illustrated in FIG. 6 with good controllability by making the longer side direction of the substrate (i.e., the dimension perpendicular to the face of the paper) as having the $[01\bar{1}]$ crystal growth direction.

Figure 8:
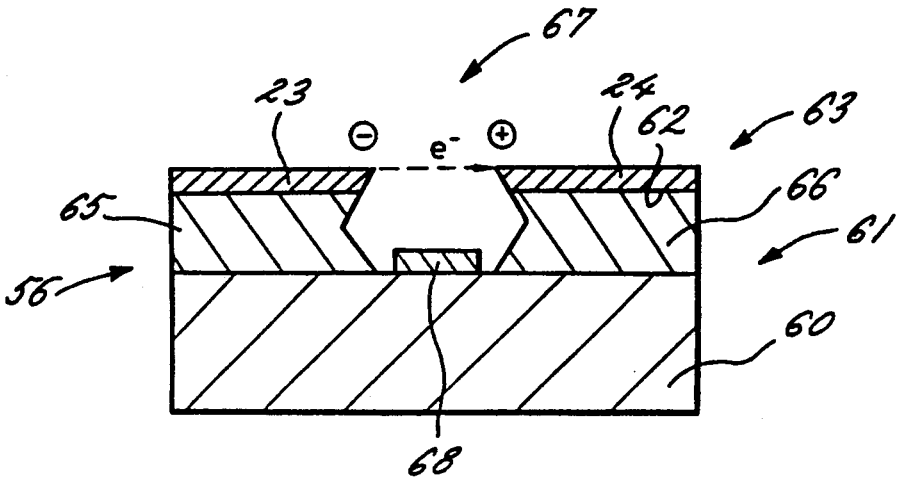
FIG. 8 is a cross sectional diagram illustrating yet a further embodiment of the present invention utilizing an insulator substrate for further reducing leakage current.

FIG. 8 illustrates a further variation of the invention in which the semiconductor substrate is provided as a composite device including an insulator section intended to reduce leakage current through the device. Thus, the substrate 56 of FIG. 8 is a composite device including an insulator base portion 60 having formed thereon a comparatively thick compound semiconductor crystalline layer 61. The insulating base portion 60 is preferably a sapphire substrate on which is heterocrystaline grown a compound semiconductor layer 61. Formed on the upper surface 62 of the semiconductor layer 61 is a lower resistance semiconductor layer 63. The composite device is masked and etched much as illustrated in FIGS. 3*a*-3*e* to form individual emitter 65 and collector 66 regions separated by a recess 67 in which is disposed a gate electrode 68. The use of compound semiconductor layers 61, 63 allows the use of the orientation dependent preferential etching techniques described in detail above to controllably form the appropriately shaped emitter electrode 65 and controllably form a gap 67 of desired dimension to produce a device much like that shown in FIG. 1. However, the device of FIG. 8 has an insulating substrate 60 which has an insulating characteristic far superior to that of GaAs further reducing the possibility of substrate leakage. The device of FIG. 8 can thus be expected to be a high performance and highly reliable device, even as contrasted with the superior device of FIG. 1. However, achieving those improved characteristics is at the price of heterocrystalline growth of semiconductor materials on sapphire, and the resulting expense. It is also noted that the FIG. 8 embodiment utilizes a sapphire substrate, but other insulating substrates which are amenable to epitaxial crystal growth may also be utilized.

It will thus be appreciated that what has been provided is an improved microminiature vacuum device. The device includes an emitter and a collector formed to face each other over a direct linear path of travel for electrons from emitter to collector. The gap between the emitter and collector is established by preferential removable or growth techniques which not only accurately and reliably control the dimension of the gap, but also the shape of the electrodes. As a result, field concentrations are maximized, and the relatively small dimensions between emitter and collector allow the use of low potentials which are capable of insuring cold method electron emission. The gate electrode is disposed very proximate the line of electron travel from emitter to collector, but out of the path such that it is relatively easy to configure the device for highly responsive gate control without the possibility of drawing substantial gate current.

What is claimed is:

1. A microminiature vacuum tube for control of electron flow in a vacuum comprising:

a compound semiconductor substrate of a III–V compound having a first planar surface, a layer of a low resistance compound semiconductor material of a III–V compound formed on the first planar surface, an elongate recess penetrating through the low resistance layer and into the substrate, the recess defining an emitter and a collector in the plane of the low resistance layer providing a direct path in said plane for electron flow from the emitter to the collector, the emitter and collector being non-metallic and comprised of said low resistance compound semiconductor material, and a gate electrode proximate but not projecting into said path, the gate electrode comprising an elongate electrode disposed in said recess intermediate the emitter and collector, the recess being of a depth sufficient to locate the gate electrode at a position proximate to but slightly displaced from said path, wherein said layer of low resistance compound semiconductor material is sufficiently thin and oriented to provide a sharp edge at the recess for at least the emitter to enhance the emission of electrons for flow along said path to the collector under control of the gate electrode.

2. The microminiature vacuum tube as set forth in claim 1 wherein the compound semiconductor substrate comprises a crystal structure of the compound semiconductor material, and the low resistance layer comprises dopant impurities associated with the first planar surface of the compound semiconductor substrate, the crystal structure of the compound semiconductor material being of a type which facilitates orientation dependent preferential etching and being oriented to facilitate a production of said sharp edge of the low resistance layer.

3. The microminiature vacuum tube as set forth in claim 1 wherein the compound semiconductor substrate comprises an insulating base carrying a crystal structure of the compound semiconductor material, the low resistance layer comprises dopant impurities associated with the portion of the compound semiconductor substrate, the crystal structure of the compound semiconductor material being of a type which facilitates orientation dependent preferential etching and being oriented to facilitate a production of said sharp edge of the low resistance layer.

4. The microminiature vacuum tube as set forth in claim 1 wherein the compound semiconductor substrate comprises GaAs, and the GaAs has a crystalline structure which is oriented such that the first planar surface of the substrate define a crystal plane with x, y, z dimension of 1, 0, 0.

5. The microminiature vacuum tube as set forth in claim 1 in which the gate electrode comprises a first elongate gate electrode disposed in the recess and proximate but out of the plane of said path, and a second elongate gate electrode disposed above the first planar surface of the substrate and proximate but out of said path, whereby said first and second elongate gate electrodes are disposed on either side of said path for the controlling electron flow therein.

6. The microminiature vacuum tube as set forth in claim 1 wherein the sharp edge formed at the emitter comprises a saw-tooth configuration having a plurality of points, the saw-tooth configuration being disposed such that the points are most proximate the collector.

7. The microminiature vacuum tube as set forth in claim 1 wherein the recess is smaller than one micron in size thereby to minimize a spacing between the collector and the emitter and thereby requirements of operating voltage for the vacuum tube.

8. A microminiature vacuum tube for control of electron flow including a compound semiconductor substrate of a III–V compound having a first planar surface, a layer of a low resistance compound semiconductor material of a III–V compound material formed on the first planar surface, a plurality of parallel elongate recesses penetrating through the low resistance layer and into the substrate, the recesses defining a plurality of arrays, each array having an emitter and a collector in the plane of the low resistance layer providing a direct path in the plane for electron flow from the emitter to the collector, the emitter and the collector being non-metallic and including the low resistance compound semiconductor material, a gate electrode disposed in each of the plurality of recesses proximate but not projecting into the path, each gate electrode comprising an elongate electrode disposed in said recess intermediate the emitter and collector, the recess being of a depth sufficient to locate the gate electrode at a position proximate to but slightly displaced from said path, and means interconnecting the emitter of one array with the collector of an adjacent array, wherein said layer of low resistance compound semiconductor material is sufficiently thin and oriented to provide a sharp edge at the recess for at least the emitter to enhance the emission of electrons for flow along the path to the collector of adjacent array under control of the gate electrode.

* * * * *